US007604229B2

(12) United States Patent
Inui

(10) Patent No.: US 7,604,229 B2
(45) Date of Patent: Oct. 20, 2009

(54) IMAGE FORMING APPARATUS AND CONTROL METHOD THEREOF

(75) Inventor: Masanobu Inui, Chigasaki (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 12/203,908

(22) Filed: Sep. 3, 2008

(65) Prior Publication Data

US 2009/0058912 A1 Mar. 5, 2009

(30) Foreign Application Priority Data

Sep. 5, 2007 (JP) ..... 2007-230580

(51) Int. Cl.
*B65H 3/44* (2006.01)
*B65H 5/26* (2006.01)

(52) U.S. Cl. ..... 271/9.05; 271/9.01; 271/9.06; 399/45; 399/389; 399/391

(58) Field of Classification Search ..... 271/9.01, 271/9.05, 9.06, 9.13; 399/45, 389, 391
See application file for complete search history.

(56) References Cited

U.S. PATENT DOCUMENTS 5,105,229 A * 4/1992 Ozaki ..... 399/17
5,127,643 A * 7/1992 DeSanctis et al. ..... 271/9.05
5,130,757 A * 7/1992 Ito ..... 399/14
5,424,821 A * 6/1995 Sampath ..... 399/45
5,721,627 A * 2/1998 Kamiya ..... 358/496
5,835,820 A * 11/1998 Martin et al. ..... 399/85
6,285,844 B1 * 9/2001 Kuga ..... 399/85
2006/0045547 A1 * 3/2006 Aiyama ..... 399/16
2008/0181637 A1 * 7/2008 Toda ..... 399/45
2008/0236736 A1 * 10/2008 Nakamura et al. ..... 156/277
2008/0290583 A1 * 11/2008 Kubo et al. ..... 271/9.01
2009/0072468 A1 * 3/2009 Ueda ..... 271/9.05

FOREIGN PATENT DOCUMENTS

JP 11-48580 A 2/1999

* cited by examiner

*Primary Examiner*—Patrick H Mackey
*Assistant Examiner*—Prasad V Gokhale
(74) *Attorney, Agent, or Firm*—Rossi, Kimms & McDowell LLP

(57) ABSTRACT

An image forming apparatus which is capable of feeding paper from a paper feeding unit when paper types set in selected paper feeding units are all the same type even if the selected paper feeding units do not include a paper feeding unit in which a predetermined paper type is set. At least one of paper feeding portions stacking a paper with the designated paper size is selected based on an attribute set to each of a plurality of paper feeding portions. in a case where a selected plurality of paper feeding portions do not include a paper feeding portion set with the predetermined attribute when the attributes set to the selected plurality of paper feeding portions are the same, a paper is fed to the image forming unit from any one of the selected plurality of paper feeding portions.

16 Claims, 13 Drawing Sheets

FIG.8

801

| AB-BASED SEARCH TABLE |
| --- |
| A5 |
| B5 |
| A4 |
| B4 |
| A3 |

802

| INCH-BASED SEARCH TABLE |
| --- |
| STMT |
| LTR |
| LGL |
| LDR |
| |

803

| A-BASED SEARCH TABLE |
| --- |
| A5 |
| A4 |
| A4 |
| |
| |

804

| AB-INCH-BASED SEARCH TABLE |
| --- |
| STMT |
| A5 |
| B5 |
| A4 |
| LTR |
| LGL |
| B4 |
| LDR |
| A3 |

IMAGE FORMING APPARATUS AND CONTROL METHOD THEREOF

BACKGROUND OF THE INVENTION

1. Field of the Invention

The present invention relates to an image forming apparatus and a control method of the image forming apparatus.

2. Description of the Related Art

Conventionally, there has been known an automatic paper selecting function of executing image processing in which paper with an optimal paper size for an image size generated based on a combination of an original size detected by a scanner or an original size designated by an operating unit and various modes is automatically selected. Specifically, a paper cassette (hereinafter, referred to as a cassette) storing the selected size of paper is automatically searched, and paper is fed from the cassette. An example of the automatic paper selecting function (automatic cassette selecting function) includes a technology proposed in Japanese Laid-Open Patent Publication (Kokai) No. H11-48580.

There has been also known an automatic paper selecting function of automatically selecting paper with an optimal paper size based on image size information and paper size information included in PDL data received from an external host.

The automatic paper selecting function also provides a function of warning the user that paper with an optimal paper size does not exist in the equipped cassettes if there is no cassette storing paper with the optimal paper size.

Not only the paper size, but also the paper type representing features of paper can be set to each cassette (a plurality of cassettes are vertically arranged). Examples of the paper type include plain paper, recycled paper, glossy paper, and Japanese paper, and the types have been increasing due to the diversification of printing.

In general, the automatic paper selecting function targets types of paper that are inexpensive, having no mode restrictions, such as plain paper and recycled paper. Expensive paper such as glossy paper and Japanese paper with many mode restrictions such as being unable to perform double-sided printing are not used in the printing process except when the user intentionally selects the paper.

However, various paper types can now be set, and operations have begun to increase in which inexpensive paper without mode restrictions is not set in the cassettes at all and only expensive glossy paper is set.

Therefore, there is no cassette that can he selected in the automatic paper selecting function if all cassettes are set with expensive paper such as glossy paper. As a result, an optimal cassette does not exist when a job using the automatic paper selection is inputted, thereby significantly degrading the usability.

SUMMARY OF THE INVENTION

The present invention provides an image forming apparatus and a control method of the image forming apparatus which are capable of feeding paper from a paper feeding unit when paper types set in selected paper feeding units are all the same type even if the selected paper feeding units do not include a paper feeding unit in which a predetermined paper type is set.

In a first aspect of the present invention, there is provided an image forming apparatus comprising an input unit adapted to input image data, an image forming unit adapted to form an image on a paper based on the image data inputted by the input unit, a paper feeding unit adapted to feed a paper to the image forming unit, the paper feeding unit including a plurality of paper feeding portions, a setting unit adapted to set an attribute of a paper stacked on each of the plurality of paper feeding portions, a designating unit adapted to designate a paper size for the image forming unit to form an image from image data inputted by the input unit, a selecting unit adapted to select at least one of paper feeding portions stacking a paper with the paper size designated by the designating unit based on the setting by the setting unit, and a controlling unit adapted to control to feed a paper to the image forming unit from a paper feeding portion set with a predetermined attribute when the paper feeding portions selected by the selecting unit include the paper feeding portion set with the predetermined attribute related to the paper, and the controlling unit controls, in a case where a plurality of paper feeding portions selected by the selecting unit do not include a paper feeding portion set with the predetermined attribute when the attributes set to the selected plurality of paper feeding portions are the same, to feed a paper to the image forming unit from any one of the selected plurality of paper feeding portions.

In a second aspect of the present invention, there is provided an A control method of an image forming apparatus, comprising an input step of inputting image data, an image forming step of forming an image on a paper based on image data inputted in the input step using an image forming unit, a paper feeding step of feeding a paper on which an image is to be formed in the image forming step from any one of a plurality of paper feeding portions, a setting step of setting an attribute of a paper stacked on each of the plurality of paper feeding portions, a designating step of designating a paper size to form an image in the image forming step from image data inputted in the input step, a selecting step of selecting at least one of paper feeding portions stacking a paper with the paper size designated in the designating step based on the setting in the setting step, and a controlling step of controlling to feed a paper to the image forming unit from a paper feeding portion set with a predetermined attribute when the paper feeding portions selected in the selecting step include a paper feeding portion set with the predetermined attribute related to the paper, and the controlling step controls, in the case where a plurality of paper feeding portions selected in the selecting step do not include a paper feeding portion set with the predetermined attribute when the attributes set to the selected plurality of paper feeding portions are the same, to feed a paper to the image forming unit from any one of the selected plurality of paper feeding portions.

According to the present invention, paper can be fed from a paper feeding unit when paper types set in selected paper feeding units are all the same type even if the selected paper feeding units do not include a paper feeding unit in which a predetermined paper type is set.

Further features and advantages of the present invention will become apparent from the following detailed description of exemplary embodiments with reference to the attached drawings.

BRIEF DESCRIPTION OF THE DRAWINGS

FIG. 5A depicts an example of a screen displayed on a liquid crystal display of FIG. 4 when the multi function peripheral is standing by.

FIG. 8 shows a search table for selecting a paper size in the multi function peripheral of FIG. 1.

DETAILED DESCRIPTION OF THE EMBODIMENTS

The present invention will now be described in detail with reference to the drawings showing a preferred embodiment thereof.

Figure 1:
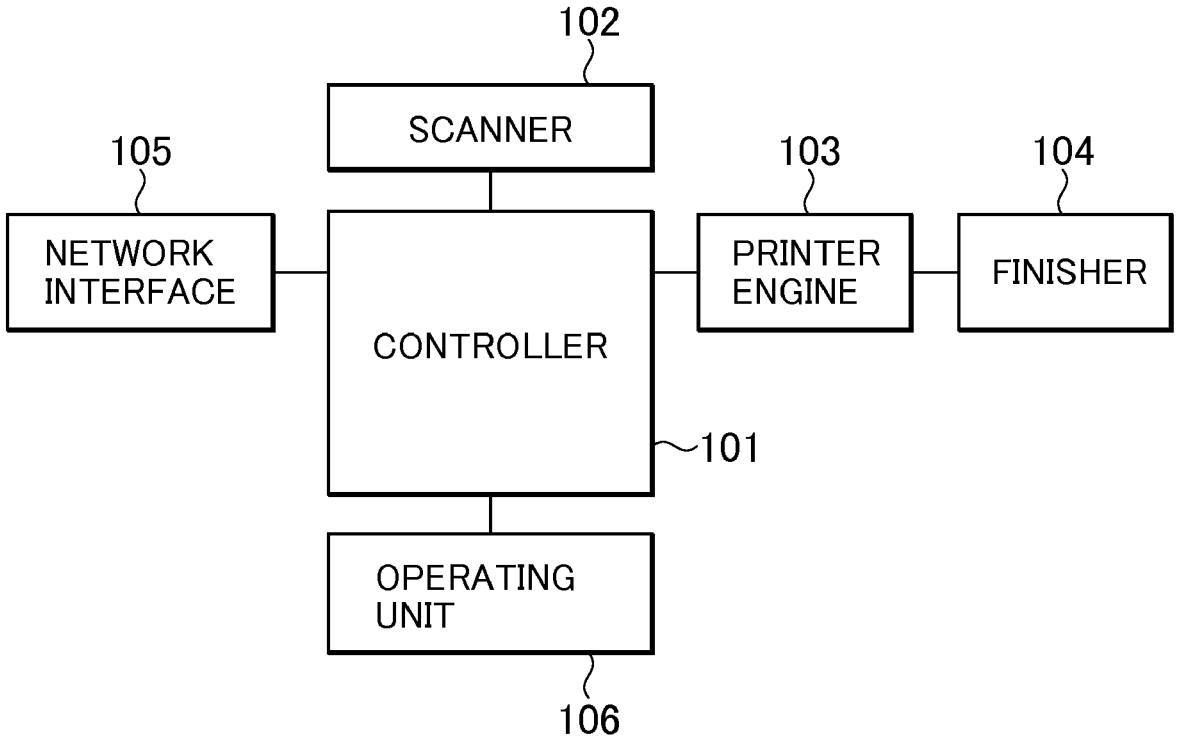
FIG. 1 is a block diagram schematically showing a configuration of a multi function peripheral as an image processing apparatus according to an embodiment of the present invention.

FIG. 1 depicts a configuration of a multi function peripheral (MFP) as an image forming apparatus according to an embodiment of the present invention.

The MFP of the present embodiment includes an automatic paper selecting function of selecting a paper size corresponding to a print setting when executing a printing process based on image data and of selecting a cassette (paper feeding unit) that accommodates the selected size of paper.

Figure 2:
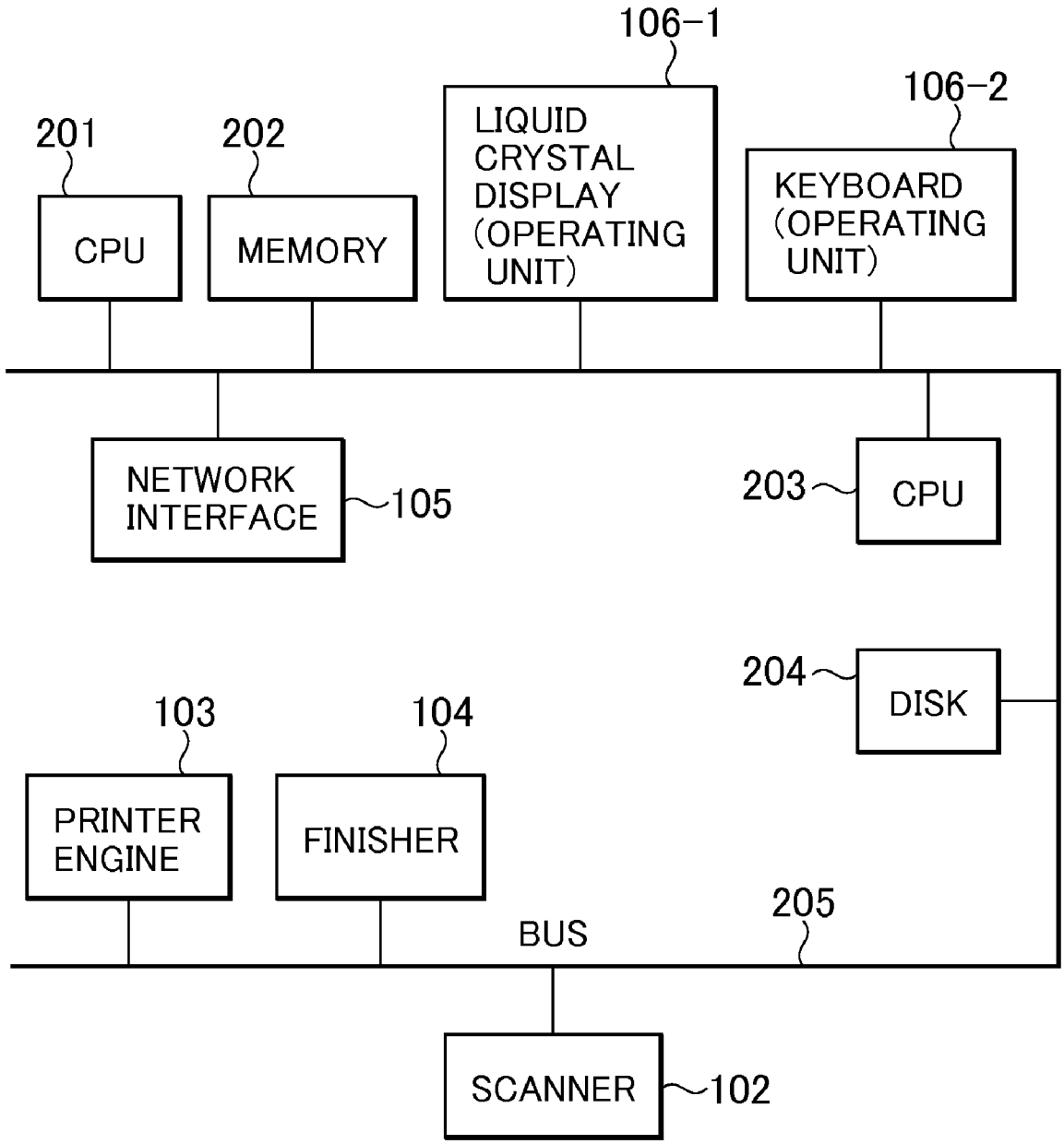
FIG. 2 shows a hardware configuration of a controller in FIG. 1.

In FIG. 1, a controller 101 comprehensively controls the MFP and has a hardware configuration shown in FIG. 2. A scanner 102 and a printer engine 103 are connected to the controller 101 and are controlled by the controller 101.

The printer engine 103 is connected to the controller 101 and functions as an image forming unit. A finisher 104 is connected to the printer engine 103 and is capable of stapling a plurality of storage medium (for example, paper), which are outputted from the printer engine 103, all together. The finisher 104 is controlled by the controller 101 through the printer engine 103.

A network (Ethernet) interface 105 functions as an input unit and provides two-way communication for the controller 101 through the interface. The network interface 105 receives (inputs) print data (image data) from a host computer (not shown) as an external device and stores the print data in a memory 202 of the controller 101. As shown in FIG. 2, an operating unit 106 is connected to the controller 101 and is constituted by a liquid crystal display 106-1 and a keyboard 106-2 described below. The operating unit 106 functions as a user interface, displays information received from the controller 101, and transmits an input instruction given by the user to the controller 101.

FIG. 2 shows a hardware configuration of the controller 101 in FIG. 1.

In FIG. 2, the controller 101 comprises a CPU 201, the memory 202, the liquid crystal display 106-1, the keyboard 106-2, a ROM 203, and a disk 204. In the controller 101, the CPU 201 is connected to the memory 202, the liquid crystal display 106-1, the keyboard 106-2, the RON 203, and the disk 204 through a bus 205.

Various programs and data are stored in the disk (storage medium) 204 such as a hard disk and a floppy disk, sequentially read out to the memory 202 on an as-needed basis, and executed by the CPU 201.

The disk 204 may be removably arranged on the MFP or may be embedded in the MFP. The programs may be downloaded from another MFP through a network and stored in the disk 204.

The liquid crystal display 106-1 and the keyboard 106-2 constitute the operating unit 106 in FIG. 1. The CPU 201 controls the display of the liquid crystal display 106-1 and controls the input from the keyboard 106-2.

The network interface 105 in FIG. 1 is connected to the bus 205. The CPU 201 performs communication using the network interface 105 by reading data from or writing data into the network interface 105.

Furthermore, the scanner 102, the printer engine 103, and the finisher 104 are connected to the bus 205. The CPU 201 transmits a command or receives a status to and from the scanner 102, the printer engine 103, and the finisher 104. The CPU 201 transmits commands to cause the scanner 102, the printer engine 103, and the finisher 104 to execute operations in accordance with the commands. The CPU 201 receives the status to recognize operating conditions of the scanner 102, the printer engine 103, and the finisher 104.

The scanner 102, the printer engine 103, and the finisher 104 may exist as stand-alone peripherals on a network, instead of inside the MFP, and the controller 101 of the MFP may control the stand-alone peripherals.

Figure 3:
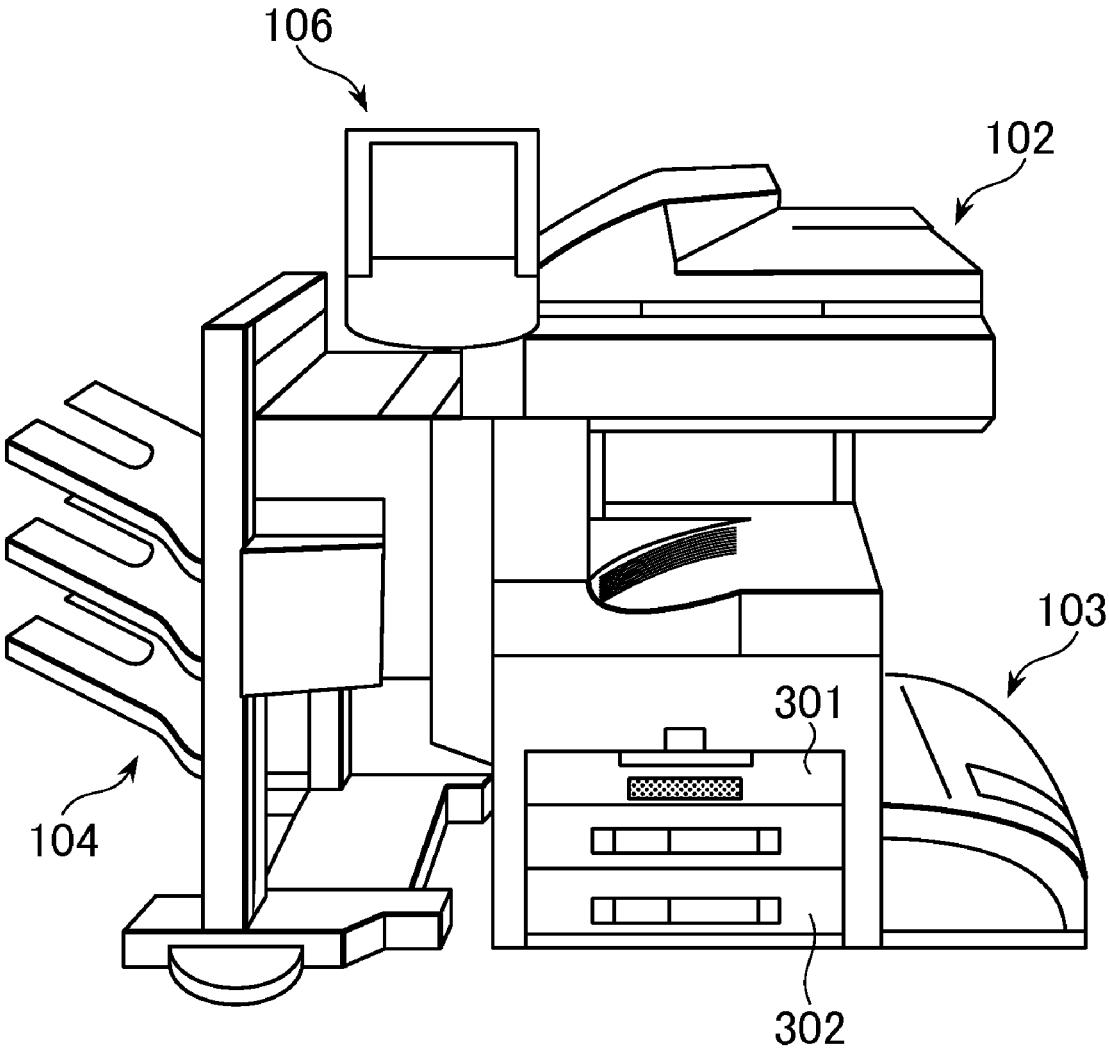
FIG. 3 depicts an appearance of the multi function peripheral of FIG. 1.

FIG. 3 shows an appearance of the MFP of FIG. 1.

In FIG. 3, the scanner 102 as an image input device causes a CCD line sensor to scan an image on an original to convert the image on the original to image data.

The printer engine 103 as an image output device is a part that prints an image on paper based on the image data. The start or end of the printing process is executed in accordance with an instruction from the CPU 201 of the controller 101.

The operating unit 106 is arranged on the side of the scanner 102, and the finisher 104 is arranged on the side of the printer engine 103.

Reference numerals 301 and 302 denote cassettes that function as paper feeding units and load stack paper for use in a printing process by the printer engine 103. As described below, the MFP can set attributes (size, type, shape, surface texture, and the like) of the paper loaded on the cassettes.

Figure 4:
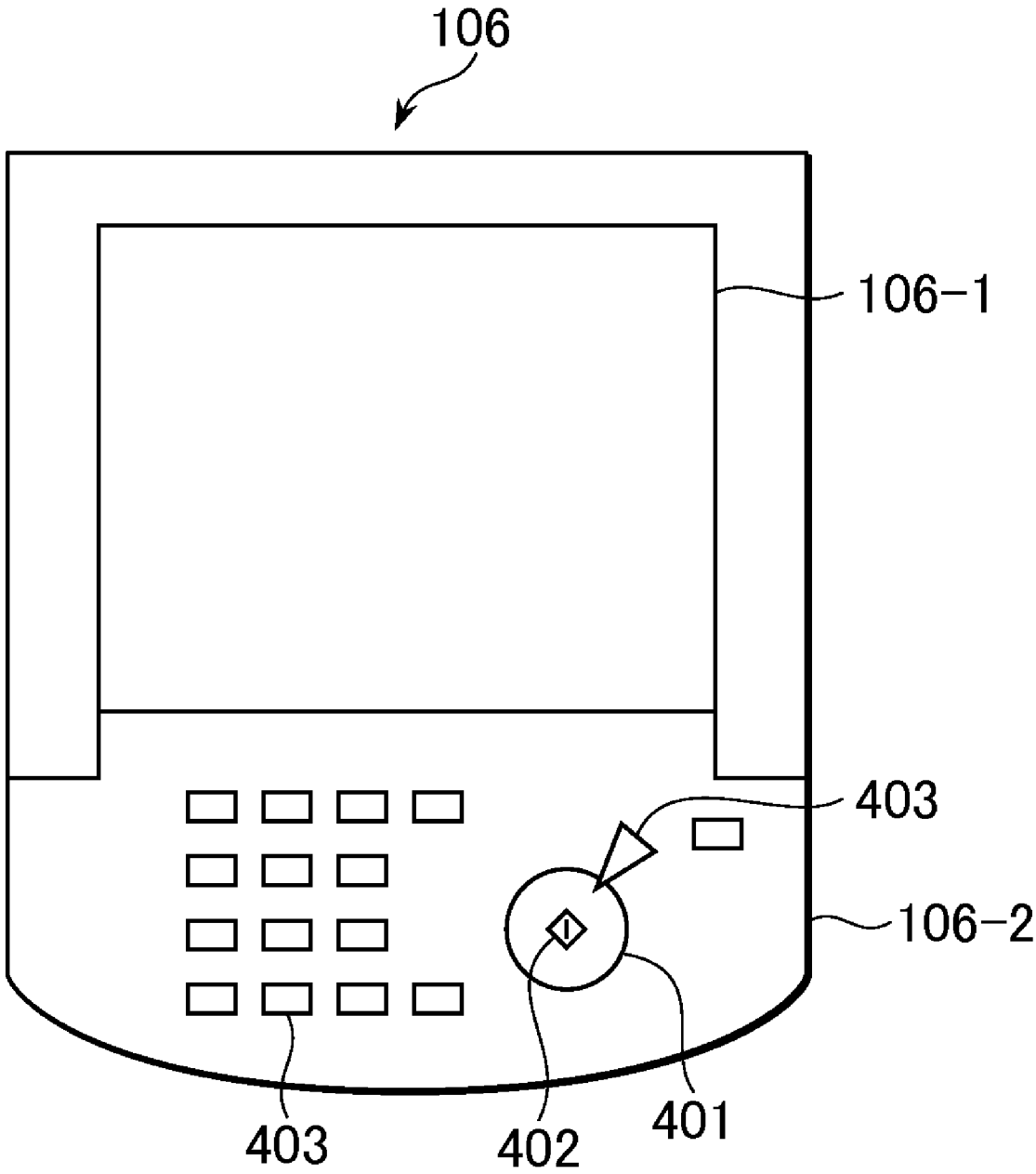
FIG. 4 depicts a configuration of an operating unit in FIG. 3.

FIG. 4 shows a configuration of the operating unit in FIG. 3.

In FIG. 4, the liquid crystal display 106-1 displays an operation screen of the system and a softkey and transmits the position information to the CPU 201 of the controller 101 when the displayed softkey is pressed.

In the keyboard 106-2, a start key 401 is a key for starting a reading operation of an original image. A two-color LED 402 of green and red exists at the center of the start key 401, the LED 402 indicating with the colors if the start key 401 can be used.

A stop key 403 is a key for stopping the movement in operation. A numeric keypad 404 is constituted by a button group of numbers and characters. The numeric keypad 404 instructs setting of the number of copies and instructs switching of the screen of the liquid crystal display 106-1.

Figure 5A:
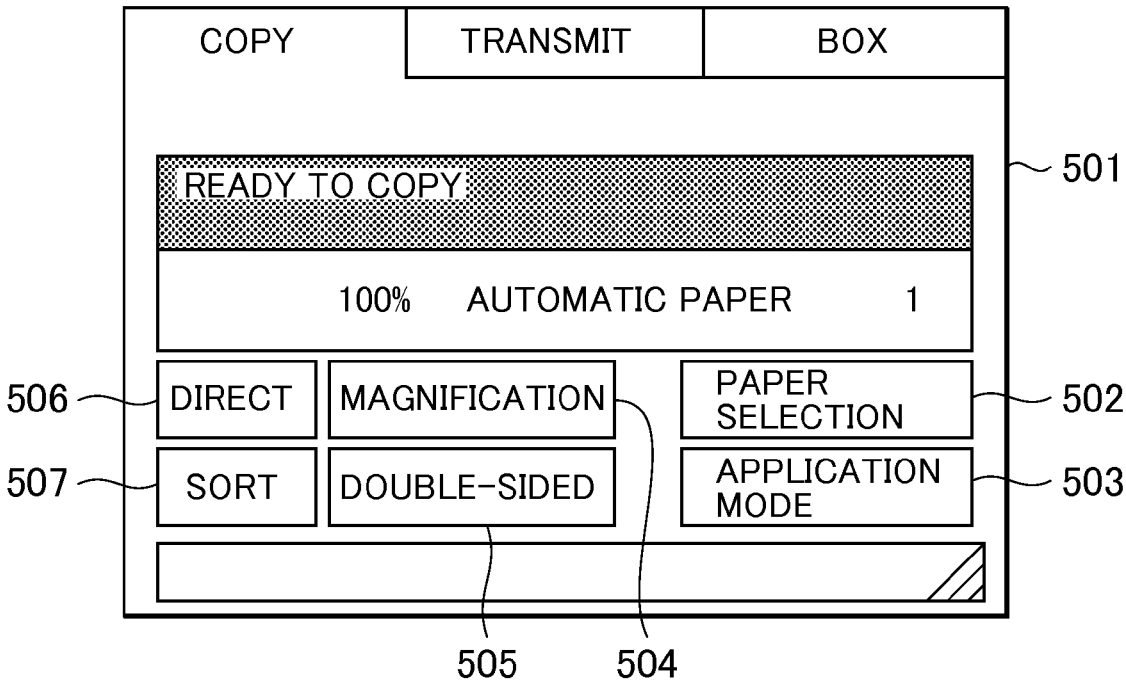
Figure 5B:
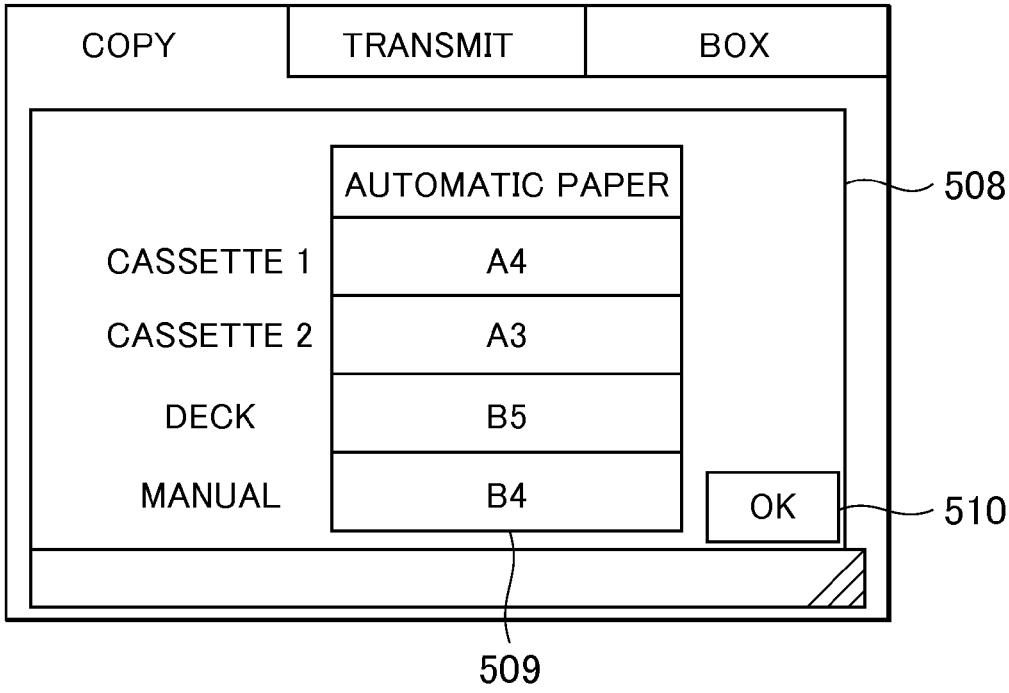
FIG. 5B depicts an example of the screen displayed on the liquid crystal display of FIG. 4 when a display selection button on the screen of FIG. 5A is pressed.

FIG. 5A shows an example of the screen displayed on the liquid crystal display of FIG. 4 when the MFP is standing by. FIG. 5B shows an example of the screen displayed on the liquid crystal display of FIG. 4 when a display selection button is pressed on the screen of FIG. 5A.

As the user of the MFP presses a paper selection button 502 in a screen 501 shown in FIG. 5A, the screen switches to a screen 508 shown in FIG. 5B, and the user can select a cassette to execute a printing process. A cassette selection button 509 can designate an automatic paper selecting mode for automatically selecting a cassette from a plurality of cassettes for use in the printing process or can designate the cassettes. When an OK button 510 is pressed, the screen returns to the screen 501.

Various image processing modes such as binding margin and frame deletion can be set when an application mode button 503 is pressed in the screen 501. A magnification setting screen is displayed and the magnification can be set when a magnification button 504 is pressed.

Double-sided copy can be set when a double-sided button 505 is pressed. The magnification is set to 100% when a direct button 506 is pressed. Staple sort, group sort, or the like can be set when a sort button 507 is pressed.

FIGS. 6A to 6H show examples of various screens displayed by pressing the numeric keypad or a button displayed on the liquid crystal display in FIG. 4.

Figure 6A:
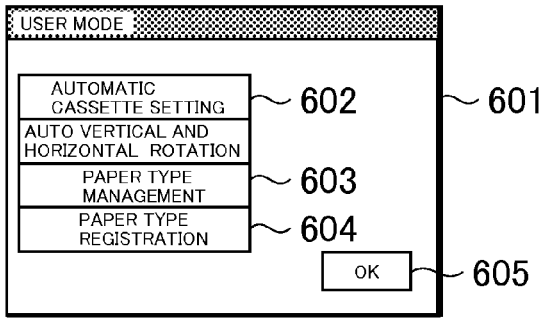
FIGS. 6A to 6H show examples of various screens displayed by pressing a numeric keypad or a button displayed on the liquid crystal display in FIG. 4.

A screen 601 shown in FIG. 6A is displayed when a user mode button in the numeric keypad 404 in FIG. 4 is pressed. The user of the MFP can set up the MFP through the screen 601. A screen 606 shown in FIG. 6B is displayed when the user of the MFP presses an automatic cassette setting button 602 in the screen 601.

Cassettes loaded in the MFP and paper sizes included in the cassettes are displayed on a screen 606. Each cassette is provided with a sensor (not shown) that detects the size of paper stacked on the cassette, and a paper size (A3, A4, B5, or the like) detected by the sensor is set to each cassette. The user of the MFP selects whether to set (ON) or not to set (OFF) the cassettes as automatic paper cassettes through a selection unit as 607. A cassette selected with ON can be used for automatic paper selection when an automatic paper selection mode is selected in FIG. 5B. A cassette selected with OFF cannot be used for the automatic paper selection when the automatic paper selection mode is selected in FIG. 5B.

Figure 6C:
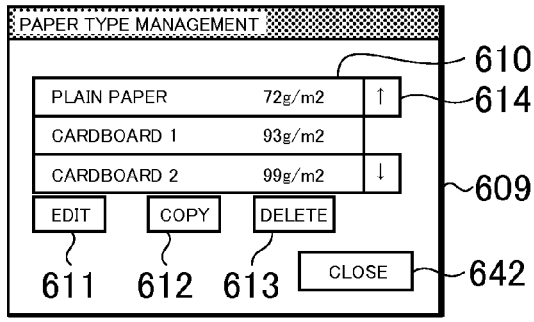
Figure 6B:
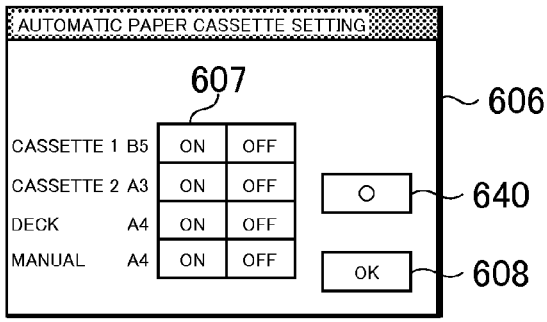

In FIG. 6B, a button 640 for dynamically changing the paper type is a toggle button, and the state of ON and OFF is changed every time the button is pressed. When the button 640 is ON, a predetermined paper type to be selected can be dynamically changed depending on the state of the paper type set to the cassette. When the button 640 is OFF, a paper type corresponding to the cassette in which the automatic paper cassette setting is ON is selected.

In the present embodiment, as described below, the predetermined paper type is plain paper or recycled paper in which the surface textures are standard The automatic paper cassette setting ends when an OK button 608 is pressed, and the screen returns to the screen 601 of FIG. 6A.

A screen 609 shown in FIG. 6C is displayed when the user of the MFP presses a paper type management button 603 in FIG. 6A. A display 610 displays a list of paper types. The list can be scrolled by pressing a move button 614.

Figure 6D:
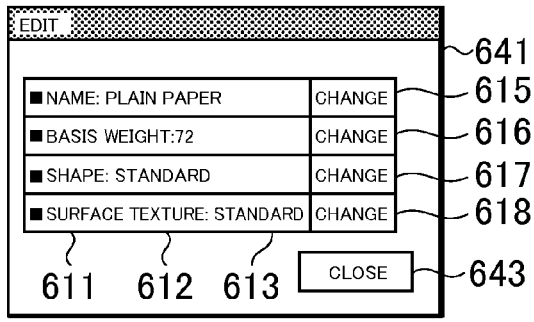

When a paper type is selected from the list and an edit button 611 is pressed, a screen 641 shown in FIG. 6D is displayed, and the paper type can be set in detail. A change button 615 is a button for changing the name of the paper type, and the character string can be edited by pressing the button.

Figure 6E:
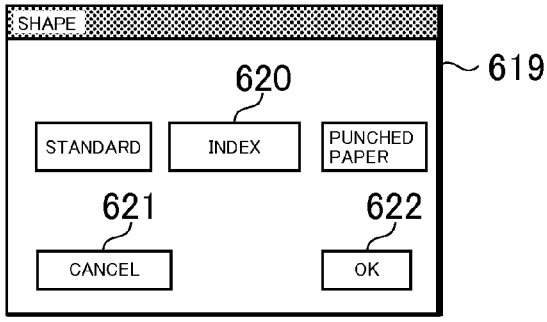

A change button 616 is a button for changing the basis weight, and an arbitrary value of the basis weight can be set by pressing the button. A change button 617 is a button for changing the shape, and a screen 619 shown in FIG. 6E is displayed when the button is pressed. A shape of paper can be selected from a button group 620. A button is selected and an OK button 622 is pressed to complete the change. A cancel button 621 is pressed if a change is not needed.

Figure 6F:
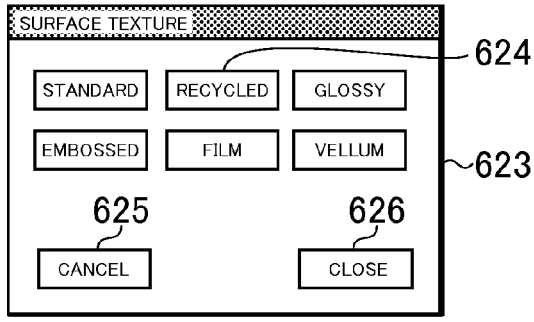

A change button 618 is a button for changing the surface texture of a paper. A screen 623 shown in FIG. 6F is displayed when the change button 618 is pressed. The surface texture of paper can be selected from a button group 624. In the present embodiment, "STANDARD", "RECYCLED", "GLOSSY", "EMBOSSED", "FILM", and "VELLUM" are set as surface textures. A button is selected from the button group 624 and an OK button 626 is pressed to complete the change of the surface texture. A cancel button 625 is pressed if a change of the surface texture is not needed.

In this way, the user of the MFP can change and set the paper type using the change buttons 615 to 618. After the setting is all finished, a close button 643 of FIG. 6D is pressed to end the setting. As the close button 643 is pressed, the screen returns to the screen 609.

A copy button 612 shown in FIG. 6C is a button for creating a copy of a paper type. When a paper type is selected from the list 610 and a copy button 612 is pressed, a paper type with the same set values as those of the selected paper type is created.

A delete button 613 is a button for deleting a paper type no longer needed from the list. A selected paper type can be deleted by selecting the paper type no longer needed from the list 610 and pressing the delete button 613. A close button 642 is pressed after the completion of the setting in the screen 609. When the close button 642 is pressed, the screen returns to the screen 601 shown in FIG. 6A.

Figure 6G:
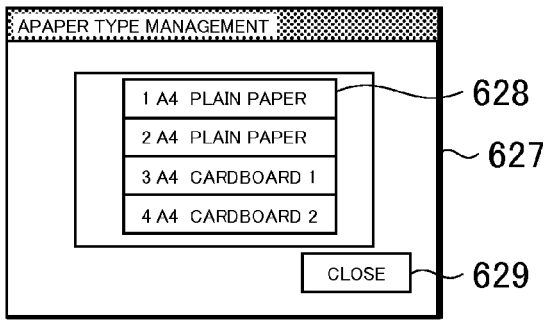
Figure 6H:
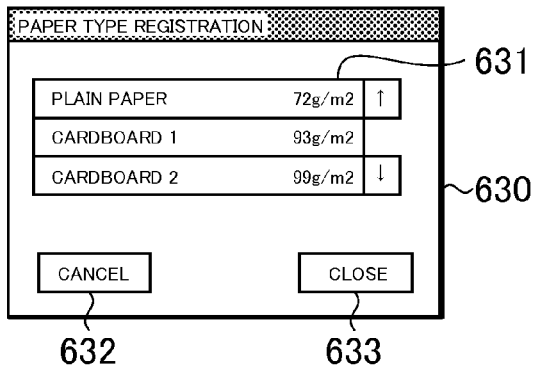

A paper type registration button 604 is a button for setting a paper type to a cassette. A screen 627 shown in FIG. 6G is displayed when the paper type registration button 604 is pressed. A cassette registered with a paper type is selected from a button group 628. When any one of the button group 628 is pressed, a screen 630 shown in FIG. 6H is displayed.

When the user designates a paper type the user intends to set from a list 631 and presses a close button 633, the designated paper type is registered to the selected cassette in FIG. 6G. A cancel button 632 is pressed when the registration is not needed. When an OK button 605 shown in FIG. 6A is pressed, the screen is returned to the screen 501 shown in FIG. 5A.

Figure 7:
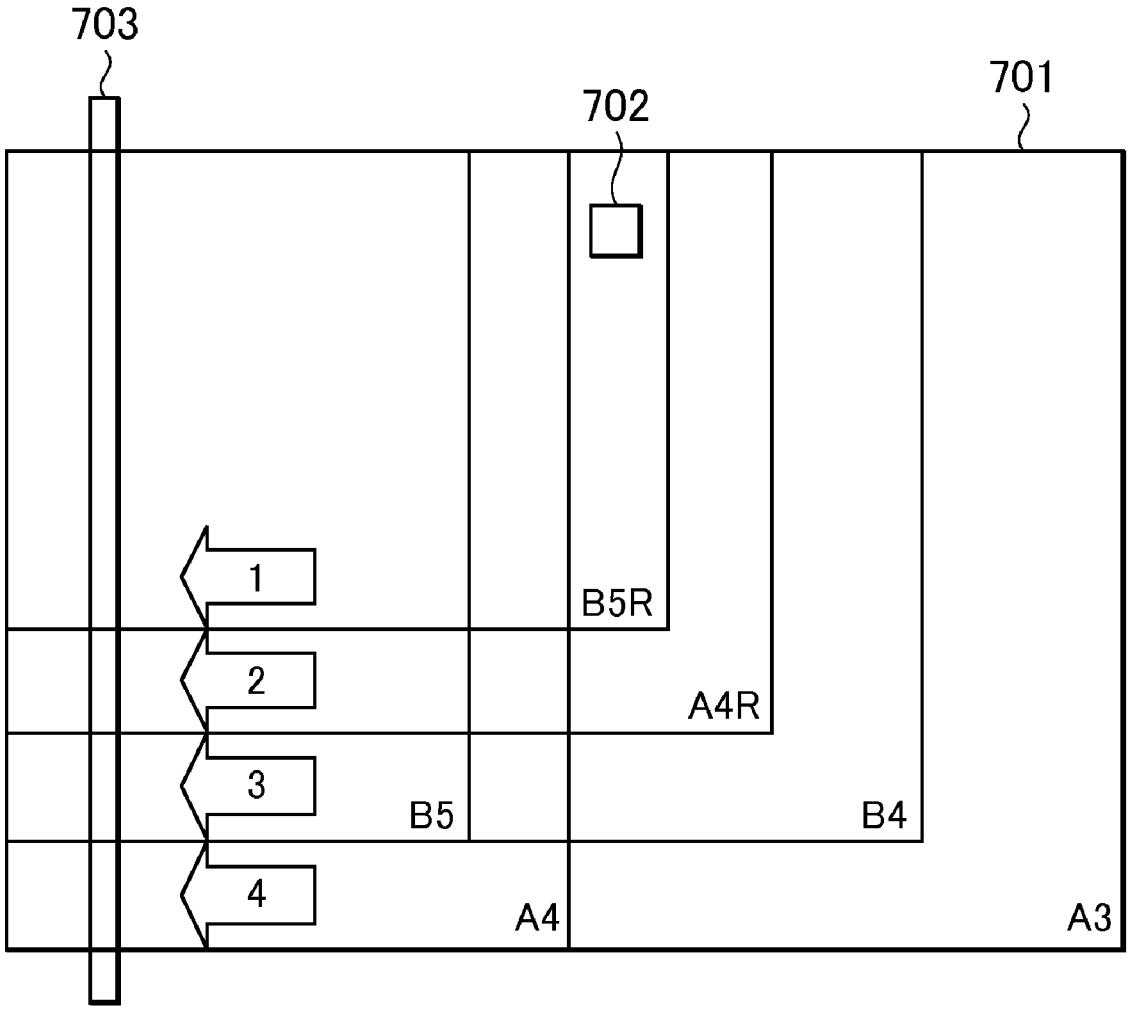
FIG. 7 shows a configuration of an original size detection system on an original platen included in a scanner in FIG. 3.

FIG. 7 is a diagram for explaining a configuration of an original size detection system included in the scanner 102 in FIG. 3 and is equivalent to a top view of an original platen 701.

In FIG. 7, the original size detection system comprises a sensor (paper existence sensor) 702 arranged near the center of the original platen 701 and a line sensor 703 arranged along the main scanning direction near one end of the original platen 701. Arrows 1, 2, 3, and 4 in FIG. 7 denote original detection positions of the line sensor 703.

An original size detection system capable of detecting A3, B4, A4, A4R, B5, and B5R will be illustrated as an example. In the present system, the original size is determined based on original detection information of the sensor 702 on the original platen 701 and original detection information of the line sensor 703.

The original size is obtained based on the detection results of the sensor 702 and the line sensor 703 when the lid of the original platen 701 is opened and closed. Specifically, the original size is determined to be A3 if the original is detected in all positions on the line sensor 703, and the original size is determined to be B5 if the positions shown with arrows 1, 2, and 3 of FIG. 7 are detected and the position shown with an arrow 4 is not detected. The relationship between the existence of detections by the sensors and the determined size is shown in a chart below.

| | Sensor 703 | | | | |
|---|---|---|---|---|---|
| Determined size | Arrow 1 | Arrow 2 | Arrow 3 | Arrow 4 | Sensor 702 |
| A3 | ○ | ○ | ○ | ○ | ○ |
| B4 | ○ | ○ | ○ | — | ○ |
| A4R | ○ | ○ | — | — | ○ |
| B5R | ○ | — | — | — | ○ |
| A4 | ○ | ○ | ○ | ○ | — |
| B5 | ○ | ○ | ○ | | — |

FIG. 8 shows a search table for selecting the paper size in the MFP of FIG. 1.

In FIG. 8, a table 801 is used for selecting AB-based paper. A size into which an image fits is searched in order from A5, and if a size into which the image fits is found, the size is set as an optimal size. A table 802 is used for selecting INCH-based paper. A table 803 is used for selecting A-based paper. A table 804 is used for selecting AB-INCH-based paper.

Figure 9:
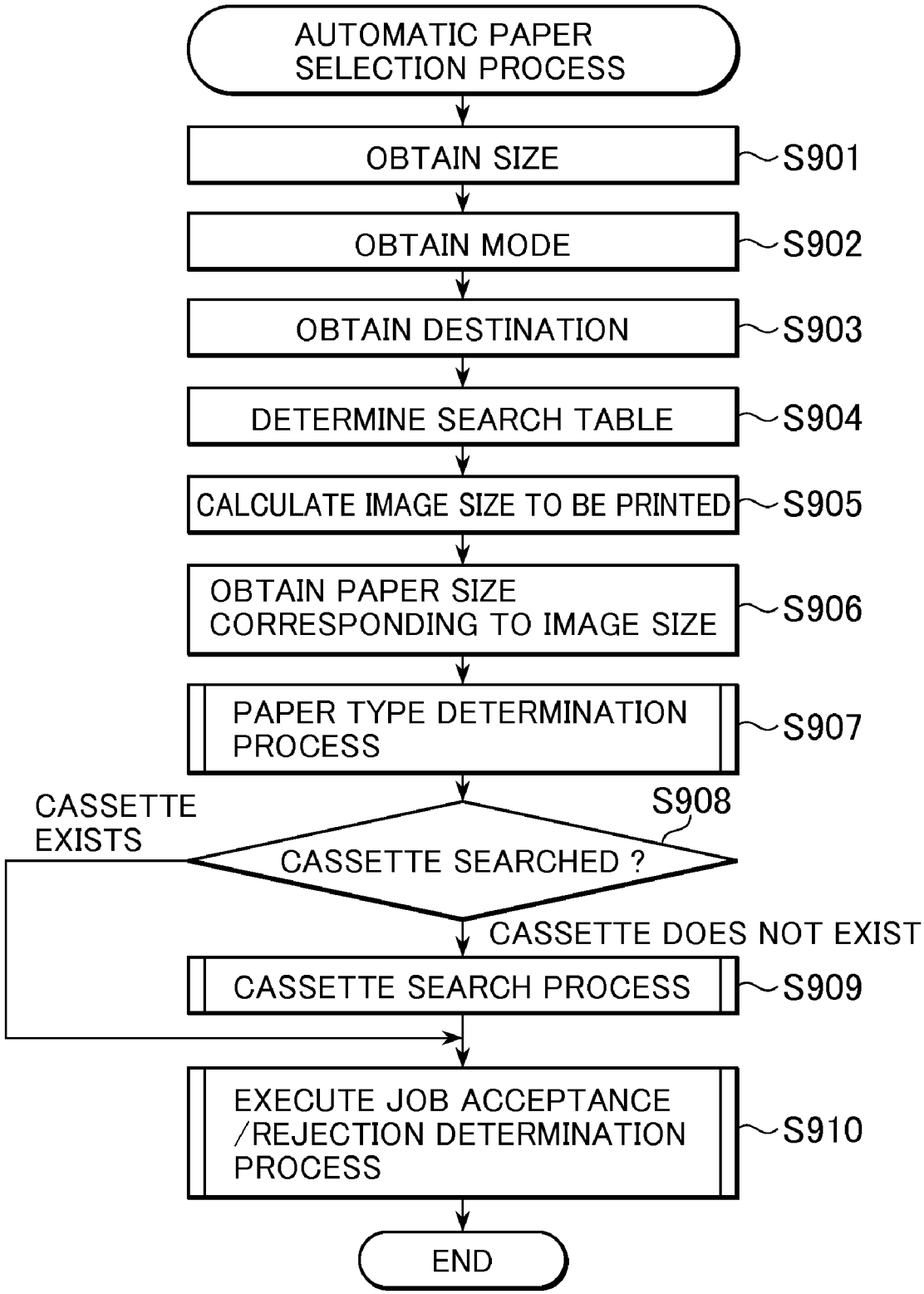
FIG. 9 is flowchart of a procedure of an automatic paper selection process executed by the multi function peripheral of FIG. 1.

FIG. 9 is a flowchart of a procedure of an automatic paper selection process (automatic cassette selection process) executed by the MFP of FIG. 1.

The controller 101 in FIG. 1, more specifically, the CPU 201 in FIG. 2 executes the automatic paper selection process.

In a step S901 of FIG. 9, when the automatic paper selection process starts, the original size of the image data used in the process is obtained, the original size is obtained in case of a copy, and the image size is obtained in case of a print request from the host computer. The original size is automatically detected in the original platen 701 using the original size detection system shown in FIG. 7, or the original size is designated from the operating unit 106 and the information of the original size is obtained. The image size is described in the print data upon printing from the host computer.

In a step S902, an image processing mode inputted in the operating unit 106 is obtained. The image processing mode indicates, for example, a setting of magnification upon copying. In a step S903, information of destination set in the MFP is obtained. The information of destination is information indicative of a country or region where the MFP is installed and is information used for selecting the table shown in FIG. 8.

In a step S904, the search table to be used is determined based on the information of destination. As shown in a chart below, the table (search table) 801 is selected because the AB-based paper needs to be selected when the destination is set to an A type. In a similar way, the table 802 is selected in case of B type, the table 803 is selected in case of C type, and the table 804 is selected in case of D type.

| Destination | Search table to be used |
|---|---|
| A type | AB-based |
| B type | INCH-based |
| C type | A-based |
| D type | AB-INCH-based |

In a step S905, an image size to be outputted is calculated from the image size obtained in the step S901 and the image processing mode obtained in the step S902. In a step 906, a paper size corresponding to the image size calculated in the step S905 is obtained from the search table determined in the step S904. In a step S907, a paper type to be automatically selected is determined.

Figure 11:
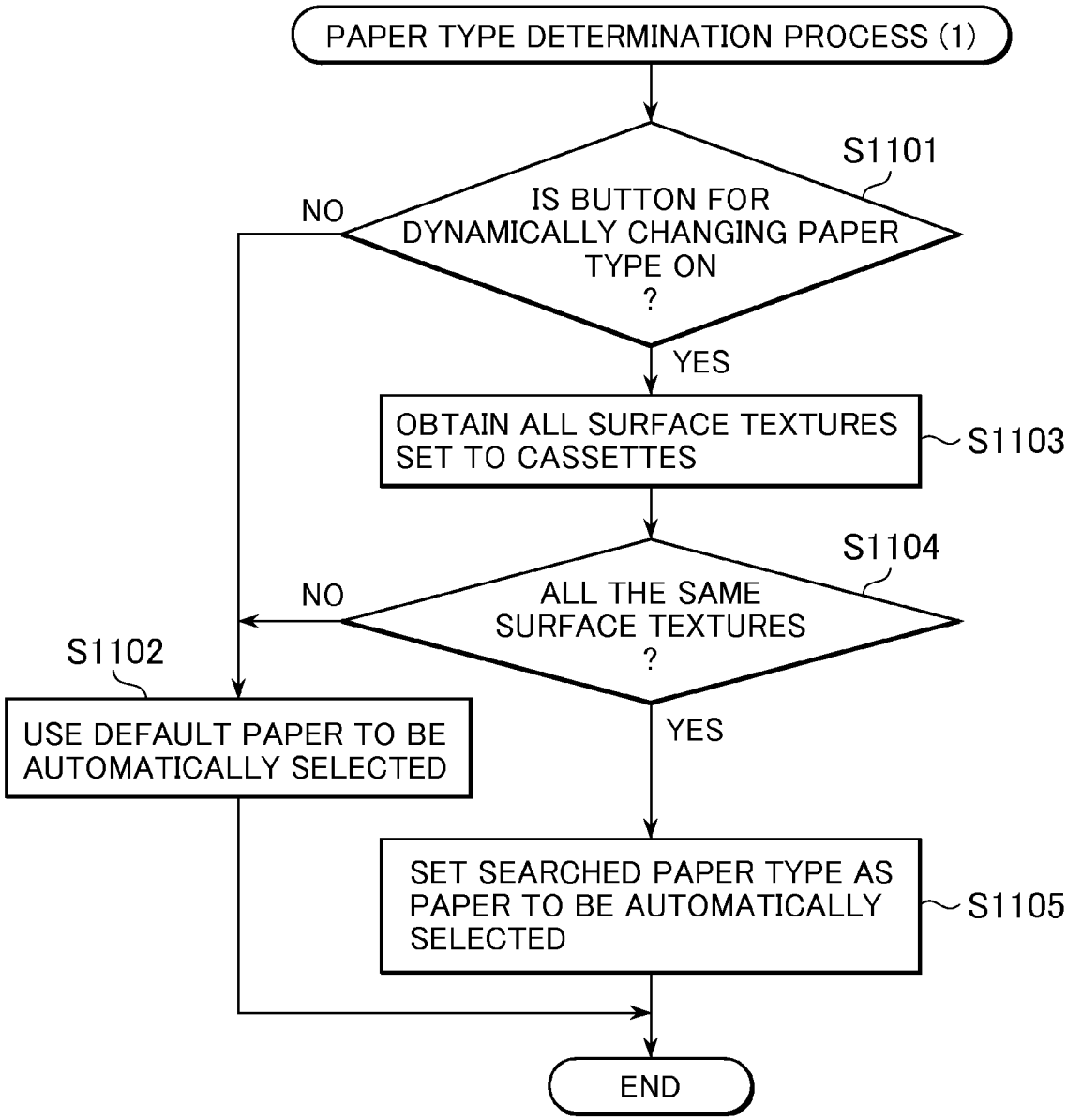
FIG. 11 is a flowchart of a first example of a procedure of a paper type determination process executed in a step S907 of FIG. 9.

FIG. 11 is a flowchart of a first example of a paper type determination process executed in the step S907 of FIG. 9.

In FIG. 11, whether the button 640 for dynamically changing the paper type shown in FIG. 6B is effective is determined in a step S1101. If the button 640 is not effective, a cassette set up with a default paper type is used in a step S1102, and the process ends. The default paper type is a paper type to be automatically selected that is preset by the user of the MFP.

If it is determined that the button 640 is effective (YES to the step S1101), all paper types (surface textures of paper in the first example) set to all cassettes stacking paper with the paper size obtained in the step S906 are acquired in a step S1103. In a step S1104, whether the same surface texture is set to all cassettes loaded with paper with the paper size obtained in step S906 is determined. If a plurality of types of surface textures are included in the surface textures set to the cassettes stacking paper with the paper size obtained in the step S906, the cassette with the default paper type set up in the step S1102 is used, followed by terminating the process. The default in the step S1102 indicates that the surface texture is standard, and the default paper to be selected indicates a cassette set up with plain paper having a standard surface texture. If all cassettes are set up with the same surface texture, the paper type acquired in the step S1103 is set as paper to be automatically selected in a step S1105, followed by terminating the process.

Figure 12:
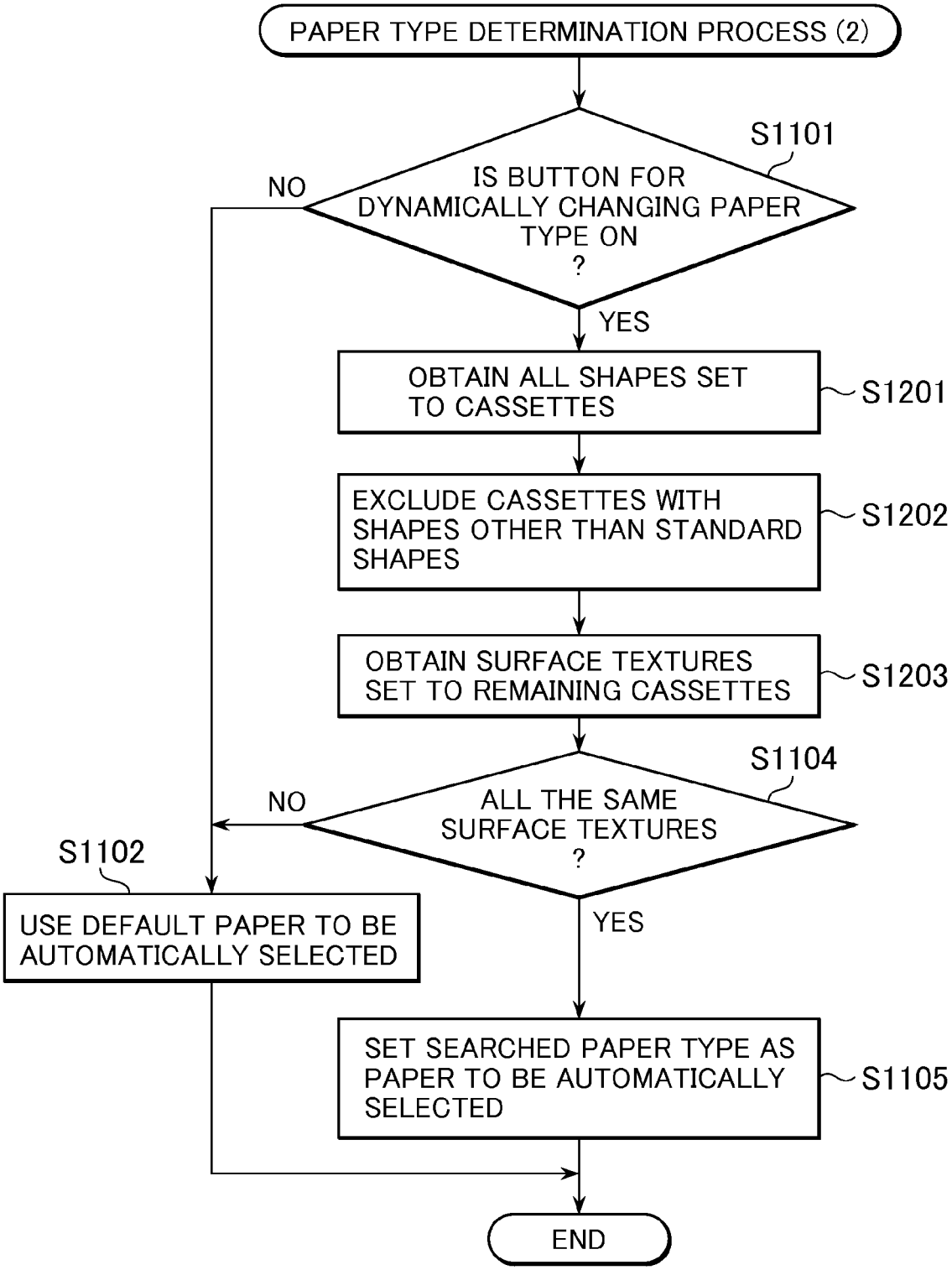
FIG. 12 is a flowchart of a second example of the procedure of the paper type determination process executed in a step S907 of FIG. 9.

FIG. 12 is a flowchart of a second example of the paper type determination process executed in the step S907 of FIG. 9.

Although the surface texture of paper is included in the paper type in the first example of the paper type determination process shown in FIG. 11, the shape of paper, in addition to the surface texture of paper, is included in the paper type in the second example of the paper type determination process shown in FIG. 12. In the flowchart of FIG. 12, steps S1201, S1202, and S1203 replace the step S1103 of FIG. 11.

In FIG. 12, paper types (surface textures and shapes of paper in the second example) set to all cassettes stacking paper with the paper size obtained in the step S906 are acquired in the step S1201, and paper types with shapes other than standard shapes are excluded in the step S1202. In the step S1203, all paper types remained from the process of the step S1202, i.e., surface textures of the paper types with standard shapes, are acquired, and the same process as that in FIG. 11 follows.

In this way, paper to be automatically selected is selected after excluding the paper types with shapes other than the standard shapes and removing index paper or the like that is less likely to be needed in the automatic paper selection. Therefore, the automatic paper selecting function can be more efficiently utilized.

In a step S908, the same size as the paper size obtained in the step S906 is set, and a cassette set with the same type as the paper type determined in the step S907 is searched. If no cassette is searched, a cassette search process is executed in a step S909. In other words, a second-choice cassette is searched. If there is a searched cassette, a job acceptance/rejection determination process is executed in a step S910, and the process ends.

In this way, according to the first example of the paper type determination process of FIG. 11, paper can be fed to the printer engine 103 from all cassettes stacking paper with the paper size obtained in the step S906 when the paper type is set to be dynamically changed and if all paper types set to the cassettes stacking paper with the paper size obtained in the step S906 are the paper types having the same surface textures. In the second example of the paper type determination process of FIG. 12, when the paper type is set to be dynamically changed and if only the paper types with standard shapes are extracted from the paper types set to the cassettes stacking paper with the paper size obtained in the step S906 and all extracted paper types are paper types having the same surface textures, the paper can be fed to the printer engine 103 from the cassettes stacking paper of the extracted paper types.

Figure 10:
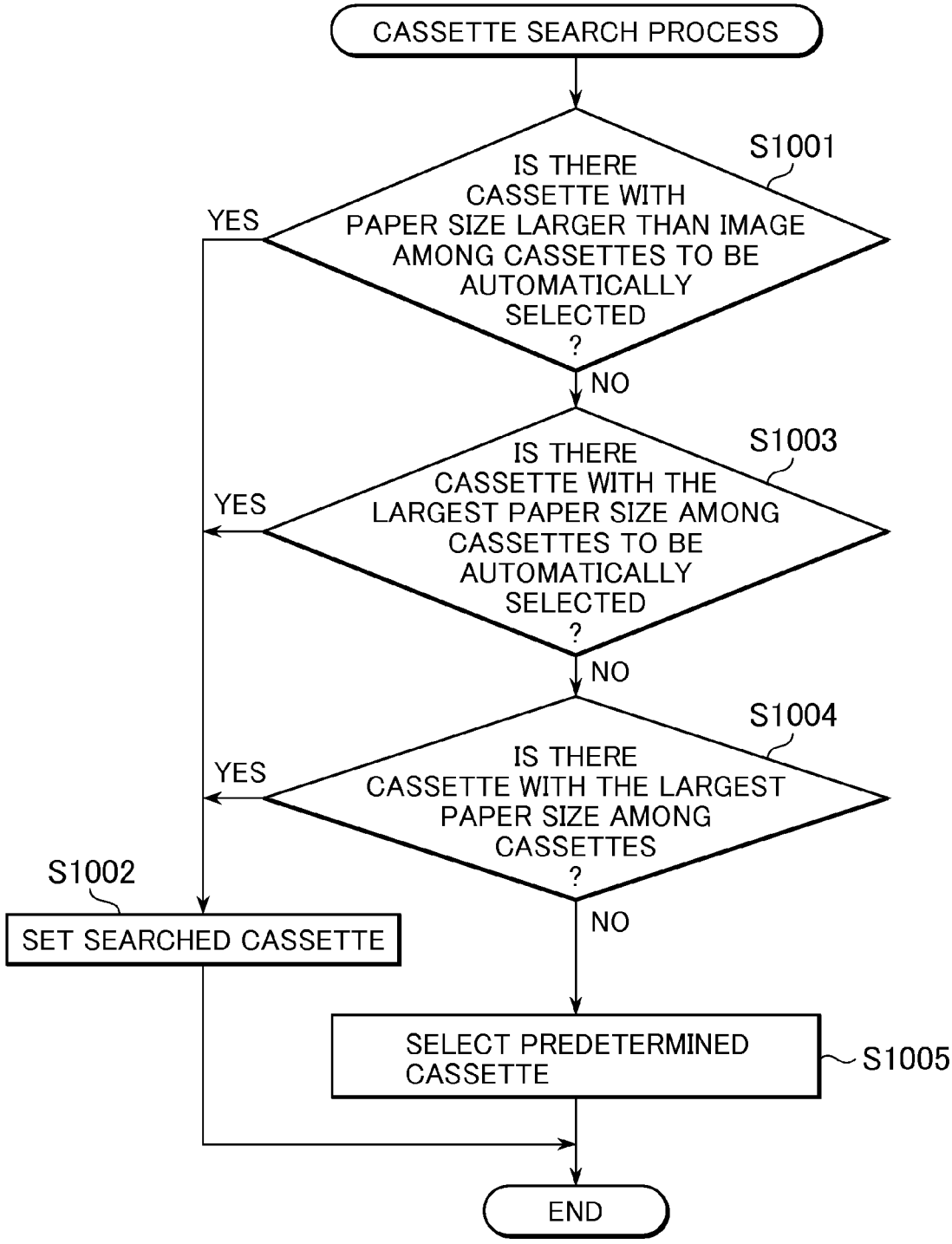
FIG. 10 is a flowchart of a procedure of a cassette search process executed in a step S909 of FIG. 3.

FIG. 10 is a flowchart of a procedure of the cassette search process executed in the step S909 of FIG. 3.

In FIG. 10, whether there is a cassette stacking paper having a size larger than the image size to be outputted among the cassettes to be automatically selected that are set with the OK button 605 of FIG. 6 is determined in a step 1001, and the cassette stacking paper having a size larger than the image size to be outputted is searched. If there is a cassette loaded with paper having a size larger than the image size to be outputted, the searched cassette is set as paper to be automatically selected in a step S1002, followed by terminating the process.

If there is no cassette searched in the step S1001, whether there is a cassette stacking paper having the largest paper size among the cassettes to be automatically selected is determined in a step S1003, and the cassette stacking paper having the largest paper size is searched. If there is a cassette stacking paper having the largest paper size among the cassettes to be automatically selected, the searched cassette is set as a cassette of paper to be automatically selected that accommodates paper having the largest paper size among all cassettes included in the MFP in the step S1002, followed by terminating the process.

If there is no cassette stacking paper having the largest paper size among the cassettes to be automatically selected, whether there is a cassette that accommodates paper having the largest paper size among all cassettes included in the MFP is determined in a step S1004, and the cassette that accommodates paper having the largest paper size among all cassettes included in the MFP is searched. If there is a searched cassette, the searched cassette is defined as a search result in the step S1002, followed by terminating the process. If there is no searched cassette, there is no cassette with paper at all. Therefore, a predetermined cassette (for example, cassette 301) is selected in a step S1005, and the process ends.

In the step S909 of FIG. 9, if there is no cassette to be searched in the step S908, another cassette is searched and a cassette for feeding paper to the printer engine 103 is selected. However, the configuration is not limited to this. For example, in the automatic paper selection process of FIG. 9, an example of a flow without the execution of the process of the step S909 includes a configuration in which paper is not fed from the cassettes stacking paper with the paper size obtained in the step S906 when a cassette is not searched in the step S908.

If a flow without the execution of the process of the step S909 is implemented in FIG. 9, the flow would be as follows. Specifically, paper is fed from a cassette stacking paper with the paper size obtained in the step S906 if all paper types set to the cassettes stacking paper with the paper size obtained in the step S906 of FIG. 9 are the same type. On the other hand, paper is not fed from a cassette stacking paper with the paper size obtained in step S906 if the paper types set to the cassettes stacking paper with the paper size obtained in the step S906 of FIG. 9 include a plurality of paper types.

According to the automatic paper selection process of FIG. 9, the paper type to be dynamically and automatically selected can be switched even if all cassettes include paper types not to be automatically selected by default. Therefore, the automatic paper selecting function can be utilized even in a particular use environment.

Figure 13:
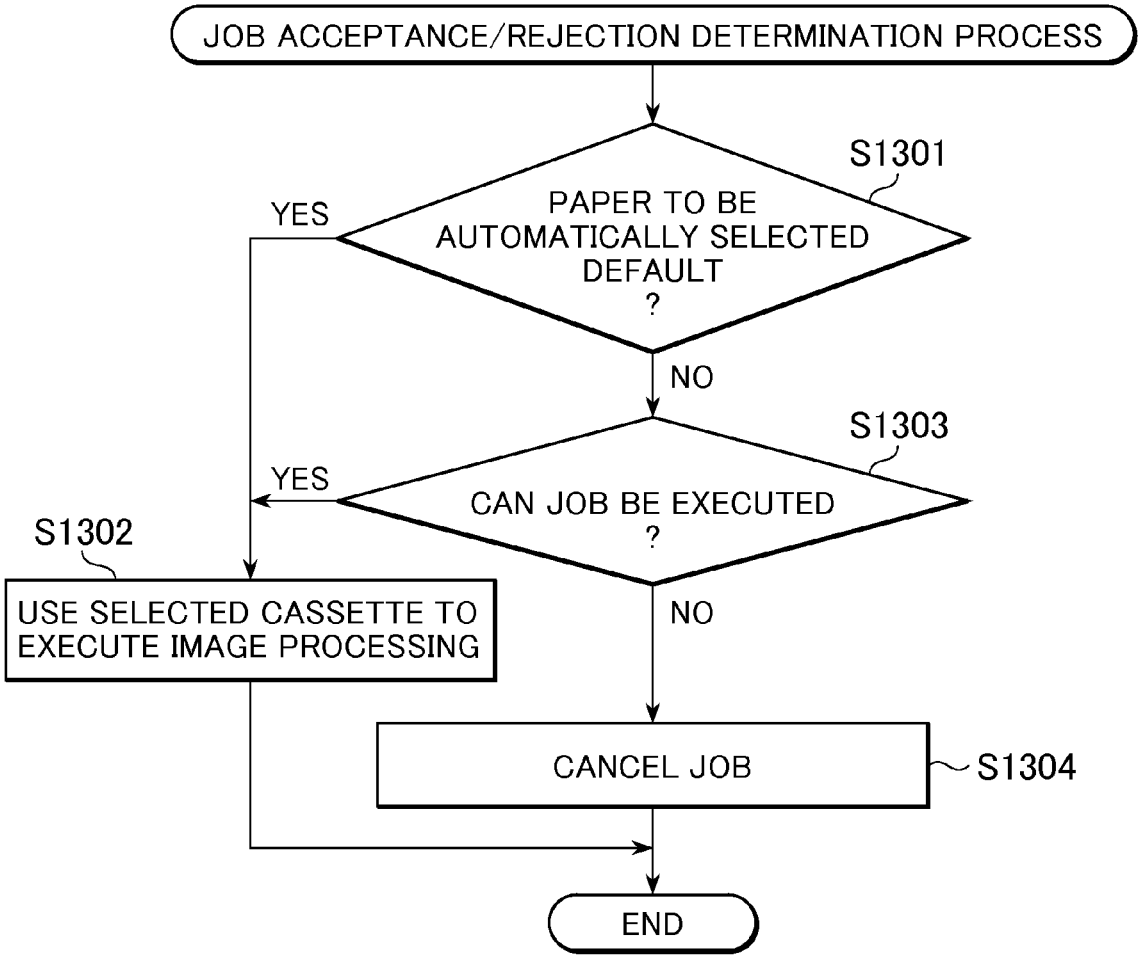
FIG. 13 is a flowchart of a procedure of a job acceptance/rejection determination process executed in a step S910 of FIG. 9.

FIG. 13 is a flowchart of a procedure of the job acceptance/rejection determination process executed in the step S910 of FIG. 9.

As the job acceptance/rejection determination process executed in the step S910 of FIG. 9 is started, whether paper to be automatically selected is a default or is dynamically generated is determined in a step S1301. If the paper to be automatically selected is a default, the selected cassette is used to execute image processing in a step S1302, followed by terminating the process.

If the paper to be automatically selected is determined not to be a default in the step S1301, whether a job can be executed is determined in a step S1303. Specifically, the image processing mode acquired in the step S902 of FIG. 9 and the paper type of the selected cassette are verified to determine whether a mode with an impossible combination is set. If a mode with an impossible combination is set, the job is canceled in a step S1304, followed by terminating the process.

For example, the job is mandatorily canceled because printing cannot be performed unless the paper in the cassette is changed if double-sided printing is set in the image processing mode, the paper type of the cassette is glossy paper, and double-sided printing is impossible with glossy paper. The job is executed in a step S1302 if printing can be executed without replacing the paper in the cassette.

By executing such a process, interruption of the operation of another user with a paper jam can be prevented by dynamically switching the paper to be automatically selected even if a paper type with many restrictions is selected.

As described, according to the present embodiment, the paper types to be automatically selected are switched in accordance with the surface textures of the paper types set to the cassettes. Therefore, the automatic paper selecting function can be executed without getting into a situation in which there is no optimal size in the automatic paper selection even if glossy paper or the like is set to all cassettes.

An operation in a conventional manner can also be selected by enabling to set whether to dynamically change the paper type to be automatically selected, thereby improving the user's convenience.

The dynamic switching of the paper to be automatically selected can be more flexibly performed by determining the surface textures of the remaining paper types after removing the paper types with shapes other than standard shapes.

Even if a paper type with many restrictions is selected as a result of the dynamic switching of the paper to be automatically selected, the image processing apparatus can be smoothly used by canceling the job when a job that cannot be executed is inputted.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of any of the embodiments described above, and hence the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-230580, filed Sep. 5, 2007, which is hereby incorporated by reference herein in its entirety.

What is claimed is:

1. An image forming apparatus comprising:

an input unit adapted to input image data;

an image forming unit adapted to form an image on a paper based on the image data inputted by said input unit;

a paper feeding unit adapted to feed a paper to said image forming unit, said paper feeding unit including a plurality of paper feeding portions;

a setting unit adapted to set an attribute of a paper stacked on each of the plurality of paper feeding portions;

a designating unit adapted to designate a paper size for said image forming unit to form an image from image data inputted by said input unit;

a selecting unit adapted to select at least one of paper feeding portions stacking a paper with the paper size designated by said designating unit based on the setting by said setting unit; and a controlling unit adapted to control to feed a paper to said image forming unit from a paper feeding portion set with a predetermined attribute when the paper feeding portions selected by said selecting unit include the paper feeding portion set with the predetermined attribute related to the paper, wherein said controlling unit controls, in a case where a plurality of paper feeding portions selected by said selecting unit do not include a paper feeding portion set with the predetermined attribute when the attributes set to the selected plurality of paper feeding portions are the same, to feed a paper to said image forming unit from any one of the selected plurality of paper feeding portions.

2. An image processing apparatus as claimed in claim 1, wherein in a case where the plurality of paper feeding portions selected by said selecting unit do not include a paper feeding portion set with the predetermined attribute when the attributes set to the selected plurality of paper feeding portions are not the same, said controlling unit controls not to feed paper to said image forming unit from the selected plurality of paper feeding portions.

3. An image forming apparatus as claimed in claim 1, wherein the attribute includes at least one of surface texture of paper, shape of paper, and basis weight of paper.

4. An image forming apparatus as claimed in claim 3, wherein said setting unit sets the surface texture of paper and the shape of paper stacked on each of the plurality of paper feeding portions to each of the plurality of paper feeding portions, and wherein said controlling unit controls to extract paper feeding portions set with papers having a predetermined shape from the selected plurality of paper feeding portions, and when the surface textures of paper set to at least one paper feeding portions set with paper having the predetermined shape are the same, controls to feed paper to said image forming unit from any one of the at least one paper feeding portions.

5. An image processing apparatus as claimed in claim 4, wherein said controlling unit controls not to feed paper to said image forming unit from the at least one paper feeding portions when the surface textures of paper set to at least one paper feeding portions set with paper having the predetermined shape are not the same.

6. An image forming apparatus as claimed in claim 1, wherein said input unit inputs the image data by converting an image on an original to the image data.

7. An image forming apparatus as claimed claim 1, wherein said input unit inputs the image data by receiving the image data from an external device.

8. An image forming apparatus as claimed in claim 1, wherein the predetermined attribute is a standard surface texture.

9. A control method of an image forming apparatus, comprising:

an input step of inputting image data;

an image forming step of forming an image on a paper based on image data inputted in said input step using an image forming unit;

a paper feeding step of feeding a paper on which an image is to be formed in said image forming step from any one of a plurality of paper feeding portions;

a setting step of setting an attribute of a paper stacked on each of the plurality of paper feeding portions;

a designating step of designating a paper size to form an image in said image forming step from image data inputted in said input step;

a selecting step of selecting at least one of paper feeding portions stacking a paper with the paper size designated in said designating step based on the setting in said setting step; and a controlling step of controlling to feed a paper to said image forming unit from a paper feeding portion set with a predetermined attribute when the paper feeding portions selected in said selecting step include a paper feeding portion set with the predetermined attribute related to the paper, wherein said controlling step controls, in the case where a plurality of paper feeding portions selected in said selecting step do not include a paper feeding portion set with the predetermined attribute when the attributes set to the selected plurality of paper feeding portions are the same, to feed a paper to said image forming unit from any one of the selected plurality of paper feeding portions.

10. A control method of an image forming apparatus as claimed in claim 9, wherein in a case where the plurality of paper feeding portions selected in said selecting step do not include a paper feeding portion set with the predetermined attribute when the attributes set to the selected plurality of paper feeding portions are not the same, said controlling step controls not to feed paper to said image forming unit from the selected plurality of paper feeding portions.

11. A control method of an image forming apparatus as claimed in claim 9, wherein the attribute includes at least one of surface texture of paper, shape of paper, and basis weight of paper.

12. A control method of an image forming apparatus as claimed in claim 9, wherein said setting step sets the surface texture of paper and the shape of paper stacked on each of the plurality of paper feeding portions to each of the plurality of paper feeding portions, and wherein said controlling step controls to extract a plurality of paper feeding portions set with paper having a predetermined shape from the selected plurality of paper feeding portions, and when the surface textures of paper set to the extracted plurality of paper feeding portions are the same, controls to feed paper to said image forming unit from any one of the extracted plurality of paper feeding portions.

13. A control method of an image processing apparatus as claimed in claim 12, wherein said controlling step controls not to feed paper to said image forming unit from the extracted plurality of paper feeding portions when the surface textures of paper set to the extracted plurality of paper feeding portions are not the same.

14. A control method of an image forming apparatus as claimed in claim 9, wherein said input step inputs the image data by converting an image on an original to the image data.

15. A control method of an image forming apparatus as claimed in claim 9, wherein said input step inputs the image data by receiving the image data from an external device.

16. A control method of an image forming apparatus as claimed in claim 9, wherein the predetermined attribute is a standard surface texture.

* * * * *